US005585226A

United States Patent [19]

Strickland et al.

[11] Patent Number: 5,585,226

[45] Date of Patent: Dec. 17, 1996

[54] POLYAMINO MONOESUCCINATES FOR USE IN PHOTOGRAPHIC PROCESSES

[75] Inventors: Alan D. Strickland, Lake Jackson; David A. Wilson, Richwood, both of Tex.; Eric R. Brown, Webster, N.Y.

[73] Assignee: Eastman Kodak Company, Rochester, N.Y.

[21] Appl. No.: 521,551

[22] Filed: Aug. 30, 1995

[51] Int. Cl.[6] ..... G03C 7/00; G03C 5/18; G03C 5/26; G03C 5/44

[52] U.S. Cl. ..... 430/393; 430/428; 430/430; 430/461

[58] Field of Search ..... 430/393, 430, 430/461, 428

[56] References Cited

U.S. PATENT DOCUMENTS

| | | | |
|---|---|---|---|
| 3,158,635 | 11/1964 | Kezerian et al. | 260/429 |
| 3,264,107 | 8/1966 | von Wartburg | 96/60 |
| 3,658,535 | 4/1972 | Willems | 96/59 |
| 3,893,858 | 7/1975 | Wabnitz, Jr. | 96/60 R |
| 4,047,956 | 9/1977 | Blake | 96/60 R |
| 4,113,489 | 9/1978 | Sugiyama et al. | 96/60 R |
| 4,294,914 | 10/1981 | Fyson | 430/418 |
| 4,304,846 | 12/1981 | Marthaler et al. | 430/392 |
| 4,563,405 | 1/1986 | Ishikawa et al. | 430/460 |
| 4,702,998 | 10/1987 | Tanaka et al. | 430/430 |
| 4,704,233 | 11/1987 | Hartman et al. | 252/527 |
| 4,707,434 | 11/1987 | Koboshi et al. | 430/393 |
| 4,737,450 | 4/1988 | Hall et al. | 430/460 |
| 4,769,312 | 9/1988 | Kishimoto et al. | 430/384 |
| 4,780,398 | 10/1988 | Kim | 430/461 |
| 4,897,339 | 1/1990 | Andoh et al. | 430/372 |
| 4,933,266 | 6/1990 | Stephen et al. | 430/393 |
| 4,983,315 | 1/1991 | Glogowski et al. | 252/102 |
| 4,985,347 | 1/1991 | Fugimoto et al. | 430/393 |
| 5,110,716 | 5/1992 | Kuse et al. | 430/429 |
| 5,238,791 | 8/1993 | Tappe et al. | 430/393 |
| 5,316,898 | 5/1994 | Ueda et al. | 430/400 |
| 5,338,649 | 8/1994 | Inaba et al. | 430/393 |
| 5,391,466 | 2/1995 | Ueda et al. | 430/393 |

FOREIGN PATENT DOCUMENTS

| | | |
|---|---|---|
| 0532003A1 | 3/1993 | European Pat. Off. . |
| 0567126A1 | 10/1993 | European Pat. Off. . |
| 0584665A2 | 3/1994 | European Pat. Off. . |
| 0588289A2 | 3/1994 | European Pat. Off. . |
| 0599620A1 | 6/1994 | European Pat. Off. . |
| 94/28464A1 | 12/1994 | WIPO . |

OTHER PUBLICATIONS

Chemical Abstract 98:117068t, 1983.
J. Majer et al., Chem. Zvesti 20(6), 414–22 (1966) and Chemical Abstract (CA 65:11738f), translation.
Derwent Abstract 91–172208/24, 1991.
Derwent Abstract 89–288901, 1989.
Derwent Abstract 89–288902, 1989.
Chemical Abstract 65:11738f, 1966.
Chemical Abstract 102:138591z, 1985.
Chemical Abstract 113:47510h, 1990.

*Primary Examiner*—Glenn A. Caldarola
*Assistant Examiner*—J. Pasterczyk
*Attorney, Agent, or Firm*—Duane C. Ulmer; J. Lanny Tucker

[57] ABSTRACT

Polyamino monosuccinic acid chelants are disclosed which have been found to be applicable in photographic processes. The polyamino monosuccinic acids can be used in a method of bleaching or bleach-fixing a silver halide photographic material comprising contacting the photographic material with a bleaching solution containing a metal complex of a polyamino monosuccinic acid as a bleaching agent.

30 Claims, No Drawings

POLYAMINO MONOESUCCINATES FOR USE IN PHOTOGRAPHIC PROCESSES

This invention relates to photographic processing and in particular to photographic bleach compositions and to methods of photographic processing employing such compositions.

BACKGROUND OF THE INVENTION

Chelants or chelating agents are compounds which form coordinate covalent bonds with a metal ion to form chelates. Chelates are coordination compounds in which a central metal atom is bonded to two or more other atoms in at least one other molecule (ligand) such that at least one heterocyclic ring is formed with the metal atom as part of each ring.

Chelants are used in a variety of applications including food processing, soaps, detergents, cleaning products, personal care products, pharmaceuticals, pulp and paper processing, water treatment, metalworking and metal plating solutions, textile processing solutions, fertilizers, animal feeds, herbicides, rubber and polymer chemistry, photofinishing, and oil field chemistry. Some of these activities result in chelants entering the environment. For instance, agricultural uses or detergent uses may result in measurable quantities of the chelants being present in water. It is, therefore, desirable that chelants degrade after use.

Biodegradability, that is susceptibility to degradation by microbes, is particularly useful because the microbes are generally naturally present in environments into which the chelants may be introduced. Commonly used chelants like EDTA (ethylenediamine tetraacetic acid) are biodegradable, but at rates somewhat slower and under conditions considered by some to be less than optimum. (See, Tiedje, "Microbial Degradation of Ethylenediaminetetraacetate in Soils and Sediments," Applied Microbiology, August 1975, pp. 327–329.) It would be desirable to have a chelating agent which degrades faster than EDTA or other commonly used chelants.

Biodegradation is of particular interest in photography, but finding a commercially useful biodegradable chelant has been difficult. In the production of color photographic images, it is usually necessary to remove the silver image which is formed coincident with the dye image. This can be done by oxidizing the silver by means of a suitable oxidizing agent, commonly referred to as a bleaching agent, in the presence of halide ion, followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

In the reversal processing of black-and-white photographic materials, a bleaching step is also utilized to remove photographically developed silver.

A wide variety of bleaching agents are known for use in photographic processing. For example, ferricyanide bleaching agents, persulfate bleaching agents, dichromate bleaching agents, permanganate bleaching agents, ferric chloride, and water-soluble quinones have been used. A particularly important class of bleaching agents are the aminopolycarboxylic acid bleaching agents, such as an ammonium or alkali metal salt of a ferric complex of ethylenediaminetetraacetic acid (EDTA). Ferric complex salts of propylenediaminetetraacetic acid (PDTA) having a higher bleaching power than EDTA have also been widely used as bleaching agents.

Although chelants or chelating agents, such as EDTA and PDTA, are effective in the bleaching step of photographic materials, there is interest in the photography industry to obtain chelants for use in the bleaching process which biodegrade more rapidly than EDTA and PDTA. Finding suitable chelants for use in photography, which are more biodegradable than what is commonly used, is difficult as the chelant must be able to chelate iron as well as have the proper redox ability.

Chelating ability is not indicative of redox ability of chelates of metal ions capable of more than one valence state. Nor can redox ability be predicted from structure as explained by R. Wichmann et al in "A New Bleaching Agent," presented at Imaging Science and Technology's 7th International Symposium on Photofinishing Technology, and published in R. Wichmann et al. "Advance Printing of Paper Summaries; Seventh International Symposium on Photofinishing Technology," Las Vegas, Nev., February 3–5, 1992 pp. 12–14.

Polyamino disuccinic acids have been recognized as having some chelating properties but have not received wide usage. For instance, a better known member of the family, namely ethylenediamine disuccinic acid (EDDS), has not been widely used because it has less ability to chelate certain metal ions such as calcium and magnesium than more widely used chelants. The preparation of polyamino disuccinic acids is discussed by Kezerian et al. in U.S. Pat. No. 3,158,635 where their use in rust removal is disclosed. Atkinson in U.S. Pat. No. 4,704,233 disclose use of EDDS in detergents to enhance removal of organic stains and mention its biodegradability.

EP patent application 0532003, published Mar. 17, 1993, EP application 0584665 published Mar. 2, 1994, and EP application 0567126, published Oct. 27, 1993, all disclose diamine compounds which are useful in processing silver halide light-sensitive photographic material. These compounds are reported to have improved biodegradability and safety. EP patent application 0599620, published Jun. 1, 1994, further discloses monoamine and polyamine compounds which can be used in processing silver halide-photographic light-sensitive material and are reported to have good degradation characteristics. The use of polyamino disuccinic acid chelating compounds in photographic bleach and bleach fixing solutions is further disclosed in WO 94/28464 published May 20, 1994.

It would be desirable to have a chelant, or a mixture of chelants, useful in photographic processes, particularly as a bleaching agent, when such chelant or mixture of chelants is greater than about 60 percent biodegradable within less than 28 days according to the OECD 301 B Modified Sturm Test or greater than about 80 percent biodegradable within less than 28 days according to the Semicontinuous Activated Sludge Test (ASTM D 2667 89).

SUMMARY OF THE INVENTION

It has been found that metal chelates of polyamino monosuccinic acid compounds are excellent oxidizing agents for use in photographic bleach and bleach-fixing solutions for the bleaching of photographic materials containing a silver halide.

In one aspect the invention includes a method of bleaching or bleach-fixing a developed silver halide photographic material comprising contacting said photographic material with a bleaching solution containing a bleaching agent comprising a metal complex of a polyamino monosuccinic acid. Additionally, the invention includes an aqueous photographic bleaching solution comprising a rehalogenating agent and as the bleaching agent a metal complex of a polyamino monosuccinic acid.

DETAILED DESCRIPTION OF THE INVENTION

The present invention is to the use of at least one polyamino monosuccinic acid in bleaching or bleach-fixing solutions used in photographic applications. It has been unexpectedly found that the metal chelates of the polyamino monosuccinic acids are excellent oxidizing agents for use in photographic bleaching or bleach-fixing solutions for the bleaching of photographic silver. Metals used include iron, manganese, cobalt or copper. The compounds are also biodegradable as measured by the OECD 301B Modified Sturm Test or the Semicontinuous Activated Sludge Test (ASTM D 2667 89).

Polyamino monosuccinic acids are compounds having at least two nitrogen atoms to which a succinic acid (or salt) moiety is attached to one of the nitrogen atoms. The compounds have at least 2 nitrogen atoms, and due to the commercial availability of the amine, preferably have no more than about 10 nitrogen atoms, more preferably no more than about 6, most preferably 2 nitrogen atoms. The remaining nitrogen atoms may be substituted with hydrogen, an alkyl, an alkylaryl, or an arylalkyl moiety. The alkyl moiety may be linear or branched, saturated or unsaturated and generally contains from 1 to 30 carbon atoms, preferably from 1 to 20 carbon atoms, and more preferably from 1 to 12 carbon atoms. The arylalkyl or alkylaryl moiety generally contains from 6 to 18 carbon atoms and preferably contains from 6 to 12 carbon atoms. The alkyl, arylalkyl, or alkylaryl moieties may also be substituted with from 0 to about 12 atoms other than carbon, such as oxygen, sulfur, phosphorus, nitrogen, fluorine, chlorine, bromine, iodine, hydrogen, or combinations thereof. Such substitutions include carboxyalkyl, hydroxyalkyl, sulfonoalkyl, phosphonoalkyl or alkylene hydroxamate groups.

Although the succinic acid moiety may be attached to any of the nitrogens, preferably the succinic acid group is attached to a terminal nitrogen atom. By terminal it is meant the first or last nitrogen which is present in the compound, irrespective of other substituents. The remaining bonds on the nitrogen having a succinic acid group are preferably bonded to a second nitrogen through an alkyl or alkylene group and the remaining bond of the nitrogen containing the succinic acid moiety is preferentially filled by a hydrogen or an alkyl or substituted alkyl group, but most preferably hydrogen. Generally the nitrogen atoms are linked by alkyl or alkylene groups, each of from about 2 to about 12 carbon atoms, preferably from about 2 to about 10 carbon atoms, more preferably from about 2 to about 8, and most preferably from about 2 to about 6 carbon atoms. The polyamino monosuccinic acid compound preferably has at least about 6 carbon atoms and preferably has at most about 50, more preferably at most about 40, and most preferably at most about 30 carbon atoms.

In one aspect of the present invention, when it is desired for the polyamino monosuccinic acid to contain a metal ion binding moiety in addition to the carboxyl groups of the succinic acid, it is desirable to place such a functional group on a nitrogen atom to which the succinic acid moiety is not bound. For example, when the polyamino monosuccinic acid contains two nitrogen atoms which are joined by an ethylene moiety, it is preferred that the nitrogen atom which is not bound to the succinic acid moiety is substituted with at least one metal ion binding moiety. In another aspect of the present invention, depending on the molecule to be made, for ease of synthesis, the nitrogen atom or nitrogen atoms to which the succinic acid moiety is not bound are generally substituted with hydrogen. For example, when the polyamino monosuccinic acid contains two nitrogen atoms joined by an ethylene moiety, it is preferred that the nitrogen atom which is not bound to the succinic acid moiety is substituted with two hydrogen atoms.

Polyamino monosuccinic acids useful in the present invention include ethylenediamine-N-monosuccinic acid, diethylenetriamine-N-monosuccinic acid, triethylenetetramine-N-monosuccinic acid, 1,6-hexamethylenediamine-N-monosuccinic acid, 2-hydroxypropylene-1,3-diamine-N-monosuccinic acid, 1,2-propylenediamine-N-monosuccinic acid, 1,3-propylenediamine-N-monosuccinic acid, cis-cyclohexanediamine-N-monosuccinic acid, trans-cyclohexanediamine-N-monosuccinic acid, ethylene-bis(oxyethylenenitrilo)-N-monosuccinic acid, ethylenediamine-N-carboxymethyl-N'-monosuccinic acid, ethylenediamine-N-carboxyethyl-N'-monosuccinic acid, ethylenediamine-N-methyl-N'-monosuccinic acid, ethylenediamine-N-phosphonomethyl-N'-monosuccinic acid, ethylenediamine-N-sulfonomethyl-N'-monosuccinic acid, ethylenediamine-N-hydroxyethyl-N'-monosuccinic acid, ethylenediamine-N-hydroxypropyl-N'-monosuccinic acid, ethylenediamine-N-hydroxybutyl-N'-monosuccinic acid, ethylenediamine-N-sulfonomethyl-N'-monosuccinic acid, ethylenediamine-N-2-hydroxy-3-sulfopropyl-N'-monosuccinic acid, ethylenediamine-N-methylene hydroxamate-N'-monosuccinic acid, diethylenetriamine-N-carboxymethyl-N"-monosuccinic acid, diethylenetriamine-N-hydroxyethyl-N"-monosuccinic acid, diethylenetriamine-N-hydroxypropyl-N"-monosuccinic acid, diethylenetriamine-N-carboxyethyl-N"-monosuccinic acid, diethylenetriamine-N-methyl-N"-monosuccinic acid, diethylenetriamine-N-phosphonomethyl-N"-monosuccinic acid, diethylenetriamine-N-sulfonomethyl-N"-monosuccinic acid, 1,6-hexamethylenediamine-N-carboxymethyl-N'-monosuccinic acid, 1,6-hexamethylenediamine-N-carboxyethyl-N'-monosuccinic acid, 1,6-hexamethylenediamine-N-hydroxyethyl-N'-monosuccinic acid, 1,6-hexamethylenediamine-N-hydroxypropyl-N'-monosuccinic acid, 1,6-hexamethylenediamine-N-methyl-N'-monosuccinic acid, 1,6-hexamethylenediamine-N-phosphonomethyl-N'-monosuccinic acid, 1,6-hexamethylenediamine-N-sulfonomethyl-N'-monosuccinic acid, 2-hydroxypropylene-1,3-diamino-N-carboxymethyl-N'-monosuccinic acid, 2-hydroxypropylene-1,3-diamino-N-carboxyethyl-N'-monosuccinic acid, 2-hydroxypropylene-1,3-diamino-N-hydroxyethyl-N'-monosuccinic acid, 2-hydroxypropylene-1,3-diamino-N-hydroxypropyl-N'-monosuccinic acid, 2-hydroxypropylene-1,3-diamino-N-methyl-N'-monosuccinic acid, 2-hydroxypropylene-1,3-diamino-N-phosphonomethyl-N'-monosuccinic acid, 2-hydroxypropylene-1,3-diamino-N-sulfonomethyl-N'-monosuccinic acid, 1,2-propylenediamine-N-carboxymethyl-N'-monosuccinic acid, 1,2-propylenediamine-N-carboxyethyl-N'-monosuccinic acid, 1,2-propylenediamine-N-methyl-N'-monosuccinic acid, 1,2-propylenediamine-N-hydroxyethyl-N'-monosuccinic acid, 1,2-propylenediamine-N-hydroxypropyl-N'-monosuccinic acid, 1,2-propylenediamine-N-phosphonomethyl-N'-monosuccinic acid, 1,2-propylenediamine-N-sulfonomethyl-N'-monosuccinic acid, 1,3-propylenediamine-N-carboxymethyl-N'-monosuccinic acid, 1,3-propylenediamine-N-carboxyethyl-N'-monosuccinic acid, 1,3-propylenediamine-N-methyl-N'-monosuccinic acid, 1,3-propylenediamine-N-hydroxyethyl-N'-monosuccinic acid, 1,3-propylenediamine-N-hydroxypropyl-N'-monosuccinic acid, 1,3-propylenediamine-N-phosphonomethyl-N'-monosuccinic acid, 1,3-propylenediamine-N-sulfonomethyl-N'-monosuccinic acid, cis & trans-cyclohexanediamine-N-carboxymethyl-N'-monosuccinic acid, cis & trans-cyclohexanediamine-N-carboxyethyl-N'-monosuccinic acid, cis & trans-cyclohexanediamine-N-methyl-N'-monosuccinic acid, cis & trans-cyclohexanediamine-N-hydroxyethyl-N'-monosuccinic acid, cis & trans-cyclohexanediamine-N-hydroxypropyl-N'-monosuccinic acid, cis & trans-cyclohexanediamine-N-phosphonomethyl-N'-monosuccinic acid, cis & trans-cyclohexanediamine-N-sulfonomethyl-N'-monosuccinic acid, ethylene-bis(oxyethylenenitrilo)-N-carboxymethyl-N'-monosuccinic acid, ethylene-bis(oxyethylenenitrilo)-N-carboxyethyl-N'-monosuccinic acid, ethylene-bis(oxyethylenenitrilo)-N-methyl-N'-monosuccinic acid, ethylene-bis(oxyethylenenitrilo)-N-hydroxyethyl-N'-monosuccinic acid, ethylene-bis(oxyethylenenitrilo)-N-hydroxypropyl-N'-monosuccinic acid, ethylene-bis(oxyethylenenitrilo)-N-phosphonomethyl-N'-monosuccinic acid, ethylene-bis(oxyethylenenitrilo)-N-sulfonomethyl-N'-monosuccinic acid, triethylenetetramine-N-carboxymethyl-N'''-monosuccinic acid, triethylenetetramine-N-carboxyethyl-N'''-monosuccinic acid, triethylenetetramine-N-methyl-N'''-monosuccinic acid, triethylenetetramine-N-hydroxyethyl-N'''-monosuccinic acid, triethylenetetramine-N-hydroxypropyl-N'''-monosuccinic acid, triethylenetetramine-N-phosphonomethyl-N'''-monosuccinic acid, and triethylenetetramine-N-sulfonomethyl-N'''-monosuccinic acid.

Preferred polyamino monosuccinic acids are those that contain two nitrogen atoms and wherein the nitrogen atom which is bound to the succinic acid moiety is substituted with hydrogen and the nitrogen atom which is not bound to the succinic acid moiety is substituted with at least one hydrogen atom.

Polyamino monosuccinic acids can be prepared for instance, by the process of Bersworth et al. in U.S. Pat. No. 2,761,874, the disclosure of which is incorporated herein by reference, and as disclosed in Jpn. Kokai Tokkyo Koho JP 57,116,031. In general, Bersworth et al. disclose reacting alkylene diamines and dialkylene triamines with maleic acid esters under mild conditions in an alcohol to yield polyamino monosuccinic acid esters which are then hydrolyzed to the corresponding acids. The reaction yields a mixture of the R and S isomers.

Polyamino monosuccinic acids with carboxyalkyl groups can be prepared by reacting the unsubstituted polyamino monosuccinic acids or their esters with the appropriate haloalkyl carboxylic acid or ester followed by hydrolysis of the ester. Polyamino monosuccinic acids with carboxyalkyl groups may also be prepared utilizing the reaction of the unsubstituted polyamino monosuccinic acids or their esters with the appropriate aldehydes and cyanide followed by hydrolysis of the nitrile and ester to the corresponding carboxyalkyl groups. Polyamino monosuccinic acids containing a hydroxyalkyl group may be prepared by reacting the unsubstituted polyamino monosuccinic acids or their esters with the appropriate alkyl oxide followed by the hydrolysis of the ester. Polyamino monosuccinic acids containing hydroxyalkyl or alkyl groups may also be prepared by reaction of the appropriate hydroxyalkylamine or alkylamine with a maleic acid ester followed by hydrolysis of the ester or by reaction of the amine with maleic acid and an alkali metal hydroxide such as sodium hydroxide. Polyamino monosuccinic acids containing phosphonoalkyl groups or sulfonoalkyl groups can be prepared by reacting the unsubstituted polyamino monosuccinic acids or their esters with the appropriate haloalkyl phosphonate or haloalkyl sulfonate, respectively followed by hydrolysis of the ester. Phosphonoalkyl groups may also be introduced by reacting the unsubstituted polyamino monosuccinic acids with the appropriate aldehyde and phosphorous acid. Certain sulfonoalkyl groups may be introduced by reacting the appropriate aldehyde and a bisulfite with the unsubstituted polyamino monosuccinic acids. Hydroxamate groups can be introduced by reacting the appropriate aminocarboxylic acid ester or anhydride with a hydroxylamine compound as described in U.S. Pat. No. 5,256,531.

Metal complexes used in the present invention are conveniently formed by mixing a metal compound with an aqueous solution of the monosuccinic acid (or salt). The pH values of the resulting metal chelate solutions are preferably adjusted with an alkaline material such as ammonia solution, sodium carbonate, or dilute caustic (NaOH). Water soluble metal compounds are conveniently used. Exemplary metal compounds include the metal nitrate, sulfate, and chloride. The final pH values of the metal chelate solutions are preferably in the range of about 4 to 9, more preferably in the range of about 5 to 8. When an insoluble metal source, such as a metal oxide, is used, the succinic acid compounds are preferably heated with the insoluble metal source in an aqueous medium at an acidic pH. The use of ammoniated amino succinic acid solutions is particularly effective. Ammoniated amino succinic acid chelants are conveniently formed by combining aqueous ammonia solutions and aqueous solutions or slurries of amino succinic acids in the acid (rather than salt) form.

The polyamino monosuccinic acid compounds, such as ethylenediamine-N-monosuccinic acid, are biodegradable by standardized tests, such as the OECD 301B Modified Sturm Test or the Semicontinuous Activated Sludge Test (ASTM D 2667 89). The first test measures the carbon dioxide produced by the test compound or standard, which is used as the sole source of carbon for the microorganisms.

The polyamino monosuccinic acid compounds are preferably employed in the form of water-soluble salts, notably alkali metal salts, ammonium salts, or alkyl ammonium salts. The alkali metal salts can involve one or a mixture of alkali metal salts although the potassium or sodium salts, especially the partial or complete sodium salts of the acids are preferred.

The polyamino monosuccinic acid compounds are particularly useful as the Fe(III) complex salts in photographic processing solutions having bleaching ability, which solutions include both bleaching solutions and bleach-fixing solutions, The term "bleaching" refers to the customary processing of photographic material containing silver halide. More specifically, it is the oxidation of a silver image, e.g. imagewise exposed and developed silver to ionic silver. This conversion is an essential step in conventional reversal processing of black-and-white materials and in the processing of both color negative and color reversal materials. Bleaching can also be used in processes for intensification of the image and in processes for partial oxidation of the silver image to decrease the optical density of that image.

The bleaching solutions are used to bleach a photographic material having at least one silver halide layer or component.

The photographic materials to be processed using the present invention can contain any of the conventional silver halides as the photosensitive material, for example, silver chloride, silver bromide, silver bromoiodide, silver chlorobromide, silver chloroiodide, and mixtures thereof. In one embodiment, however, the photographic material contains a high chloride content, containing at least 50 mole percent silver chloride and more preferably at least 90 mole percent silver chloride.

The level of silver in the element can be any amount conventionally used in the art, but is generally less than about 10 g/m$^2$. Preferably, it is less than about 2 g/m$^2$. In the case of photographic papers, the levels are preferably below 1 g/m$^2$, and more preferably, less than 0.8 g/m$^2$. Lower amounts can be used if desired.

The photographic materials processed in the practice of this invention can be single color elements or multicolor elements. Multicolor materials typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. The element can contain additional layers such as filter layers, interlayers, overcoat layers, subbing layers and the like as is well known in the art. The element may also contain a magnetic backing such as is also known in the art.

Considerably more details of photographic elements of many varieties are provided in the Research Disclosure, page 501, No. 36544 (1994) the disclosure of which is incorporated herein by reference. Such details relate, for example, to useful silver halide emulsions (either negative-working or positive-working) and their preparation, color-forming couplers, color developing agents and solutions, brighteners, antifoggants, image dye stabilizers, hardeners, plasticizers, lubricants, matting agents, paper and film supports, and the various image-formation processes for both negative-image and positive-image forming color elements.

The photographic elements can be imagewise-exposed with various forms of energy which encompass the ultraviolet and visible and infrared regions of the electromagnetic spectrum, as well as electron-beam and beta radiation, gamma ray, X-ray, alpha particle, neutron radiation and other forms of corpuscular and wave-like radiant energy in either noncoherent (random phase) forms or coherent (in phase) forms as produced by lasers. The conditions under which the photographic elements are imagewise-exposed are well known to those of ordinary skill in the art.

The monosuccinic acid compounds used as bleaching agents which are components of the bleaching compositions and bleach-fixing compositions of this invention are preferably utilized in the form of water-soluble salts, such as ammonium or alkali metal salts, of a metal polyamino monosuccinic acid complex. Alternatively, the metal complexes of the present invention are used as free acid (hydrogen), alkali metal salt (such as sodium salt, potassium salt, lithium salt), ammonium salt, or a water soluble amine salt such as triethanolamine salt. Preferably, the potassium salt, sodium salt or ammonium salt is used.

The bleaching or bleach-fixing solutions may contain two or more members of the metal complexes of the present invention in combination. These solutions may also contain conventional bleaching agents such as Fe(III) complex salts of nitrilotriacetic acid, ethylenediaminetetraacetic acid, β-alaninediacetic acid, methyliminodiacetic acid and ethylenediaminedisuccinic acid. When the Fe(III) complex salts of the present invention are used in combination with conventional bleaching agents, the Fe(III) complex of the present invention accounts for at least 10 mole % of the total amount of the total bleaching agents.

The amount of the polyamino monosuccinic acid compounds to be used depends on the amount of silver and the silver halide composition in the light-sensitive material to be processed. It is preferred to employ about 0.01 mole or more, more preferably about 0.05 to about 1.0 mole, per liter of solution employed; preferably there is a molar ratio of succinic acid compounds to metal ion of from about 1:1 to about 5:1. In a supplemental solution, for supplying a smaller amount of more concentrated solution, such as a replenishment solution or regenerator solution used in photographic processing, the solution is conveniently employed at the maximum concentration permitted by the solubility of the monosuccinic acid compounds. The bleach compositions of this invention preferably contain about 5 to about 400 grams per liter of the succinic acid compound bleaching agents, more preferably about 10 to about 200 grams per liter.

The processing solutions having bleaching ability include both bleach solutions and bleach-fixing solutions. These solutions accordingly contain a metal complex salt of the succinic acid compounds used as a bleaching agent and are operated in a pH range from about 2 to 8, more preferably about 3.5 to 7.5, most preferably about 4.0 to 6.5. The temperature for processing is lower than 80° C., more desirably between about 35° C. and 65° C. to suppress evaporation. The processing time for bleaching is 10 seconds to four minutes and preferably 15 seconds to 3 minutes.

The bleach or bleach-fix compositions optionally contain other additives within the skill in the art, such as amines, sulfites, mercaptotriazoles, alkali metal bromides, alkali metal iodides, thiols and the like. An additional silver halide solvent such as water-soluble thiocyanate or potassium thiocyanate is optionally included in the bleach-fix compositions. The bleach or bleach-fix compositions optionally contain uncomplexed chelating agent.

Other additives, which can contribute to bleach-fixing characteristics, include alkali metal halides or ammonium halides, such as potassium bromide, sodium bromide, sodium chloride, ammonium bromide, ammonium iodide, sodium iodide, potassium iodide, and the like. Other optional additives include solubilizing agents such as triethanolamine, acetylacetone, phosphonocarboxylic acid, polyphosphoric acid, organic phosphonic acid, oxycarboxylic acid, polycarboxylic acid, alkylamines, polyethyleneoxides and the like within the skill in the art for use in bleaching solutions.

Use of special bleach-fixing solutions such as a bleach fixing solution comprising a composition in which a halide such as potassium bromide is added in a small amount, or alternatively a bleach-fixing solution in which a halide such as potassium bromide, ammonium bromide and/or ammonium iodide, or potassium iodide is added in a large amount, and, in addition, a bleach-fixing solution with a composition comprising a combination of the bleaching agent of the present invention and a large amount of a halide such as potassium bromide is within the scope of the invention.

Silver halide fixing agents suitable for incorporation in the bleach-fixing solutions of the present invention are preferably compounds within the skill in the art for fixing-processing which can react with a silver halide to form a water soluble complex, and include thiosulfates such as potassium thiosulfate, sodium thiosulfate, ammonium thiosulfate, and the like; thiocyanates such as potassium thiocyanate, sodium thiocyanate, ammonium thiocyanate, thiourea, thioether; highly concentrated bromides, iodides, and the like. These fixing agents are conveniently used in amounts within the range which can be dissolved, namely 5 g/liter or more, preferably 50 g/liter or more, more preferably 70 g/liter or more; more preferably there are less than about 400, most preferably less than about 200 grams per liter.

The fixing or bleach-fixing solutions may contain one or more substances which can accelerate fixing. Some of these materials are described in Chapter 15 of "The Theory of the Photographic Process", 4th edition, T. H. James, ed., Macmillan, N.Y., 1977. Such substances include ammonium salts such as ammonium chloride, amines such as ethylenediamine and guanidine, thiourea, and thioether compounds such as 3,6-dithia-1,8-octanediol.

The bleach-fixing solutions of the present invention optionally also contain various pH buffers such as boric acid, borax, sodium hydroxide, potassium hydroxide, sodium carbonate, potassium carbonate, sodium bicarbonate, acetic acid, sodium acetate, ammonium hydroxide, other substituted and unsubstituted carboxylic acids, substituted and unsubstituted dicarboxylic acids such as maleic acid or succinic acid or their salts and the like either singly or in a combination of two or more compounds. Optional ingredients include various fluorescent whitening agents, defoaming agents, antifungal agents, preservatives such as hydroxylamine, hydrazine, sulfites, metabisulfites, bisulfite adducts of aldehyde or ketone compounds, or other additives. Particularly useful hydroxylamines include substituted or unsubstituted dialkylhydroxylamines including, but not limited to, those described in U.S. Pat. Nos. 5,354,646 and 4,876,174. Representative useful hydroxylamine antioxidants are bis(sulfonatoethyl)hydroxylamine and N-isopropyl-N-sulfonatoethylhydroxylamine. Organic solvents such as methanol, dimethylformamide, dimethyl sulfoxide, and the like are optionally included. Addition of a polymer or a copolymer having a vinyl pyrrolidone nucleus as disclosed in Japanese Provisional Patent Publication No. 10303/1985 is also within the scope of the invention.

Other optional compounds in the bleach-fixing solution of the present invention for accelerating bleach-fixing characteristics, include tetramethylurea, phosphoric trisdimethylamide, s-caprolactam, N-methylpyrrolidone, N-methylmorpholine, tetraethyleneglycol monophenyl ether, acetonitrile, glycol monomethyl ether, and the like.

After exposure of the photographic element to form a latent image, further processing of the element includes the step of contacting the element with a color developing agent to reduce developable silver halide and to oxidize the color developing agent. Oxidized color developing agent in turn reacts with the coupler to yield a dye. Color developer solutions are well known in the art, and contain various additives besides the color developing agent. Antioxidants are usually included, for example, the hydroxylamines described above (such as substituted or unsubstituted monoalkyl or dialkylhydroxylamines).

With negative working silver halide, the processing step gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching and fixing to remove silver and silver halide, washing and drying.

In some cases, a separate pH lowering solution, referred to as a stop bath, is employed to terminate development prior to bleaching. A stabilizer bath is commonly employed for final washing and hardening of the bleached and fixed photographic element prior to drying.

Representative examples of preferable processing methods, particularly color negative films and color print papers, may include the various steps as shown below:

(1) Color developing→Bleach-fixing→Water washing (2) Color developing→Bleach-fixing→Washing with a small amount of water→Water washing (3) Color developing→Bleach-fixing→Water washing→Stabilizing (4) Color developing→Bleach-fixing→Stabilizing (5) Color developing→Bleach-fixing→First Stabilizing→Second Stabilizing (6) Color developing→Water washing (or stabilizing)→Bleach-fixing→Water washing (or stabilizing)

(7) Color developing→Pre-fixing→Bleach-fixing→Water washing (8) Color developing→Pre-fixing→Bleach-fixing→Stabilizing (9) Color developing→Pre-fixing→Bleach-fixing→First stabilizing→Second stabilizing

(10) Color developing→Stopping→Bleach-fixing→Water washing→Stabilizing.

(11) Color developing→Bleaching→Bleach-fixing→Water washing

(12) Color developing→Bleaching→Fixing→Water washing→Stabilizing

(13) Color developing→Bleaching→Fixing→Stabilizing

(14) Color developing→Bleaching→Fixing→Water washing→Stabilizing

(15) Color developing→Bleaching→Rinsing→Fixing→Washing→Stabilizing

(16) Color developing→Bleaching→Bleach-fixing→Fixing→Stabilizing

Of these processing methods, methods of (3), (4), (5), (8), (9) and (16) are preferably employed in the present invention, with processing methods (4), (5), (8), (9) and (16) most preferred.

For color reversal films representative examples of preferable processing methods may include the various steps as shown below:

(17) Non-chromogenic developing→Washing→Reversal bath→Color developing →Bleach conditioner→Bleaching→Fixing→Washing→Stabilizer

(18) Non-chromogenic developing-+Washing->Reversal bath-+Color developing →Bleach conditioner/stabilizer→Bleaching→Fixing→Washing→Final rinse

(19) Non-chromogenic developing→Washing→Reversal bath→Color developing →Bleach conditioner→Bleaching→Washing→Fixing→Washing→Stabilizer

(20) Non-chromogenic developing→Washing→Light re-exposure→Color developing→Bleach conditioner→Bleaching→Fixing→Washing→Stabilizer spectrum was consistent with ethylenediamine-N-carboxymethyl-N'-monosuccinic acid and methanol. The powder was placed into a vacuum oven at 40° C. After 4 days, the material was a dry, slightly yellow powder with a weight of 37.24 g (overall yield 73%).

EXAMPLE 5

In 100 ml of dry tertiary butanol, 10.32 g (0.1 mole) of dry diethylenetriamine were dissolved, and the resulting solution was sparged with dry nitrogen. After cooling to 10° C., 14.41 g (0.1 mole) dimethyl maleate was slowly added while maintaining the solution temperature below 20° C. The solution then was maintained at room temperature for three days. Although no precipitate formed, NMR analysis indicated completion of the reaction by the disappearance of the methine carbons of maleate. The solvent was removed by vacuum evaporation resulting in a viscous, clear liquid. This liquid was dissolved in 30 milliliters of water and mixed with 30 milliliters of 10M sodium hydroxide. The resulting solution was then refluxed for about four hours. After refluxing, the solution was passed through a cationic exchange column (MSC-1-H) in the acid form. Fractions from the column were collected and concentrated by vacuum evaporation of the water. A total of 13.30 g (0.061 mole) of product was recovered and confirmed by NMR analysis to be (2-aminoethyl)-N'-2-aminoethyl-N-aspartic acid (i.e., diethylenetriamine-N-monosuccinic acid).

EXAMPLE 6

About 75.1 g of water and 64.0 g of 50% (by weight) sodium hydroxide (0.8 mole) were placed into a stainless steel reactor equipped with a reflux condenser, thermometer, magnetic stirrer bar, and heating mantle. Maleic acid (44.5 g, 0.38 mole) was dissolved in the solution with five minutes of stirring. Over a 10 minute period, 2-(2-aminoethyl)-aminoethanol (42.1 g, 0.40 mole) was added. The reaction mixture was refluxed for two days and then cooled to room temperature. Half of this solution was then placed in a beaker in an ice-water bath and hydrobromic acid (65.9 g of 49% solution, 0.4 mole) added while stirring and maintaining the temperature below 25° C. The resulting solution had a pH of 5.2 and precipitated some fumaric acid after standing for three hours. The fumaric acid was removed by filtration and the filtrate was stirred into 1130 g of methanol. After 30 minutes of stirring, the slurry was filtered and rinsed with 400 ml of methanol. The material was dried in a vacuum oven at 75° C. for several hours. After drying, 31.5 g (0.14 mole) of product was produced and confirmed by NMR analysis to be (2-hydroxyethyl)-N'-(2-aminoethyl)-N-aspartic acid (i.e., ethylenediamine-N-hydroxyethyl-N'-monosuccinic acid).

EXAMPLE 7

A 1.95 g (0.011 mole) quantity of the ethylenediamine-N-monosuccinic acid prepared in Example 1 was dissolved in 200 g deionized water. The pH was adjusted from 5.3 to 7.1 by addition of an aqueous ammonium hydroxide solution. Iron nitrate (2.4 g, 0.00507 mole) was then added to the solution with stirring. The resulting pH of 3.1 was adjusted to about 5.0 with aqueous ammonium hydroxide, and the solution was diluted to a final volume of 500 milliliters. Fifty gram aliquots were placed in separate vessels and adjusted to pH 5.0, 6.0, 7.0, 8.0, 9.0, and 10.0 with ammonium hydroxide. After 21 days, the solutions were filtered and analyzed by inductively coupled plasma spectroscopy for soluble iron. The results are as follows:

| pH | ppm Fe | % Fe in solution |
|---|---|---|
| 5 | 555 | 100 |
| 6 | 545 | 98 |
| 7 | 534 | 96 |
| 8 | 540 | 97 |
| 9 | 528 | 95 |
| 10 | 9 | 1.7 |

EXAMPLE 8

A 1.02 gram (0.0058 moles) quantity of ethylenediamine-N-monosuccinic acid from Example 1 and 200 grams of deionized water were placed in a beaker. The solution was stirred with a magnetic stirrer bar and approximately 2.4 grams of iron nitrate solution (11.8% iron) was added with stirring. The iron chelate solution (pH=2.1) was diluted in a volumetric flask to a final volume of 500 milliliters. Fifty gram aliquots of the above solution were placed in 2 ounce bottles and the pH adjusted to 5.0, 6.0, 7.0, 8.0, 9.0 and 10.0 by the addition of a few drops of aqueous ammonia solution. After the samples stood for 6 weeks, they were filtered and analyzed for soluble iron by inductively coupled plasma spectroscopy. The results are as follows:

| pH | ppm Fe | % Fe in solution |
|---|---|---|
| 5 | 500 | 99.2 |
| 6 | 529 | 99.2 |
| 7 | 533 | 100 |
| 8 | 520 | 97.2 |
| 9 | 3 | <1 |
| 10 | 0.9 | <1 |

EXAMPLE 9

A 1.35 g (0.0061 mole) quantity of the material from Example 6 was dissolved in 200 milliliters of deionized water and stirred. Iron nitrate (2.35 g, 0.0050 mole) was added to the solution which was then diluted to 500 ml. Fifty gram aliquots were placed in separate vessels and adjusted to pH values of 6.0, 7.0, 8.0, 9.0, and 10.0 with the addition of aqueous ammonium hydroxide. After 16 days, the solutions were filtered and the filtrates were analyzed by inductively coupled plasma spectroscopy for soluble iron. The results are as follows:

| pH | ppm Fe | % Fe in solution |
|---|---|---|
| 6 | 544 | 100 |
| 7 | 536 | 99 |
| 8 | 538 | 99 |
| 9 | 530 | 97 |
| 10 | 21 | 4 |

EXAMPLE 10

The reduction potential of the material prepared in Example 6 was determined by making the ferric complex. The ferric complex was 0.001 molar iron and 0.0011 molar ethylenediamine-N-hydroxyethyl-N'-monosuccinic acid in 0.1 molar $NaClO_4$ adjusted to pH 5 with NaOH and $HClO_4$. The half cell potentials were measured by normal pulse polarography as detailed in *Electrochemical Methods, Fun-*

*damentals and Applications* by A. J. Bard and L. F. Faulkner, 1980, Wiley. Correcting the results to the standard Ag/AgCl electrode gives the half cell potential of Fe EDTA as −150 mV and of Fe ethylenediamine-N-hydroxyethyl-N'-monosuccinic acid as −55 mV. This redox potential indicates that the ferric complex of ethylenediamine-N-hydroxyethyl-N'-monosuccinic acid is suitable for use as a bleaching agent for desilvering a silver halide photographic material.

EXAMPLE 11

The reduction potential of the material prepared in Example 1 was measured by the same method as in Example 10. The half cell potential of Fe ethylenediamine-N-monosuccinic acid was −140 mV. This redox potential indicates that the ferric complex of ethylenediamine-N-monosuccinic acid is suitable for use as a bleaching agent in desilvering a silver halide photographic material.

EXAMPLE 12

The biodegradability of the material prepared in Example 1 was measured by both the ASTM D 2667-89 (SemiContinuous Activated Sludge) test and the OECD 301B Modified Sturm test. The ASTM D 2667-89 test exposes the organisms in sludge to about 33 ppm of the test compound each day for 28 days. After 23 hours of contact with the sludge, the remaining compound is analyzed. In order to pass the test, a minimum of 80% of a compound must be degraded during each 23 hour period for at least 7 consecutive days during the 28 day period. The ethylenediamine-N-monosuccinic acid was more than 80% degraded within the prescribed time for passing the ASTM D 2667-89 test. The OECD 301B Modified Sturm test measures the $CO_2$ produced by the test compound or standard, which is used as the sole carbon source for the microorganisms. The ethylenediamine-N-monosuccinic acid was tested at a 20 ppm dose level. In addition to a vessel containing the test compound, a vessel containing acetate as a standard compound, and a vessel containing innoculum as a blank were used as controls. The seed innoculum was obtained from microorganisms previously exposed to ethylenediamine-N-monosuccinic acid in a semi-continuous activated sludge test. To confirm the viability of each seed innoculum, acetic acid was used as the standard at a concentration of 20 ppm. The blank vessel is used to determine the inherent $CO_2$ evolved from each respective innoculum. Carbon dioxide captured in the respective barium hydroxide taps was measured at various times during the 28-day test period. The results from this test indicated that the material was over 75 percent biodegraded within the prescribed time. A value of greater than 60% of the theoretical amount of $CO_2$ produced in this test indicates that a compound is readily biodegradable.

EXAMPLE 13

The material prepared in Example 3 was subjected to biodegradability testing in the ASTM D 2667-89 test as described in Example 12. Results from this test show that the material was greater than 80% biodegraded within the prescribed time.

EXAMPLE 14

Bleach-Fixing in a Flow Cell

Samples of KODAK DURACLEAR™ transparency film were given a flash exposure (2 sec, 3000K lamp) then developed and fixed (but not bleached) at 37.7 degrees C using conventional color paper processing solutions, using the following protocol:

| | |
|---|---|
| 120 seconds | Developer bath |
| 60 seconds | 3% acetic acid stop bath |
| 60 seconds | Water wash |
| 240 seconds | Fixing bath |
| 180 seconds | Water wash |
| 60 seconds | Rinse bath |

The film samples were air-dried. To measure a rate of bleaching, a 1.3 $cm^2$ round piece was cut from the film sample and placed in a flow cell. This cell, 1 cm×1 cm×2 cm, was constructed to hold the round film sample in the light path of a diode-array spectrophotometer, enabling light absorption of the round film to be measured while processing solution was circulated over the sample piece. Both the processing solution, 50 ml, and the flow cell were held at a constant temperature of 25 degrees C. Three hundred absorbance measurements at 810 nm were collected at 2 second intervals over a 600-second period of time. The absorbance was plotted as a function of time, and the time required for 50% bleaching was determined graphically. Control experiments indicated that this flow cell method is an excellent predictor of bleaching rates in a standard process run at 37.7 degrees C.

The resulting bleach-fixing rates at pH 6.0 using the following bleach-fixing processing solution composition are presented in Table1.

| Bleach-fixing solution composition | |
|---|---|
| Ferric nitrate | 0.025 mol/L |
| Ammonium nitrate | 0.96 mol/L |
| Ammonium thiosulfate | 0.21 mol/L |
| Ammonium sulfite | 0.018 mol/L |
| Iron complexing ligand | (see Table 1) |
| pH 6.0 adjusted with ammonium hydroxide | |

The molar ratios of ligand-to-iron are also given in Table 1.

TABLE 1

| Ligand | Mol ratio to Iron | Time for 50% Bleaching (s) |
|---|---|---|
| EDMS | 1.1 | 140 |
| EDMS | 2.2 | 122 |
| AEEA-MS | 1.1 | 156 |
| AEEA-MS/MIDA | 1.0/1.1 | 144 |
| AEEA-MS/MIDA | 1.0/2.2 | 97 |

[Wherein EDMS = ethylenediamine-N-monosuccinic acid; AEEA-MS = ethylenediamine-N-hydroxyethyl-N'-monosuccinic acid; MIDA = methyliminodiacetic acid]

It is clear from the results in Table 1 that the ligands of this invention bleach silver rapidly. Moreover, mixtures of ferric complex salts of two ligands also rapidly bleach silver from this film.

EXAMPLE 15

Bleach-fixing Rates of Silver Removal

Sample strips of KODAK DURACLEAR™ film and sample strips of Kodak B&W Motion Picture Film (5302) were flash exposed (5 sec, 3000K light), then developed and fixed, but not bleached, using a conventional color process and a black and white process, respectively.

A sample strip of each film type was bleached in a bleach-fix processing solution at pH 6.2 for times of 0, 30, 60, 90, 120, 150, 180, 210, 240, 270 and 300 seconds, then removed from the solution, washed in water and dried. The infra-red density (1000 nm) for each bleaching time is plotted against the square root of time. A straight line is drawn through the points and extrapolated to zero density. The square root of the time at zero density is squared to obtain the clear time for silver removal in Table 2. The bleach-fix composition used to process both film-types is as follows:

| | |
|---|---|
| Ferric nitrate | 0.111M |
| Ligand | (see Table 2) |
| Glacial acetic acid | 10 ml/L |
| Ammonium thiosulfate | 0.42M |
| Ammonium sulfite | 0.1M |
| pH 6.2 adjusted with ammonium hydroxide | |

The ratios of iron-complexing ligand to ferric ion are also provided in Table 2.

TABLE 2

| Ligand | Mol Ratio to Iron | Clear Time (seconds) DURA-CLEAR | 5302 |
|---|---|---|---|
| EDDS (comparison) | 1.1 | 155 (avg of 2) | 237 (avg of 2) |
| EDMS (invention) | 1.1 | 220 | 316 |
| EDMS (invention) | 2.1 | 207 | 267 |
| AEEA-MS (invention) | 1.1 | 200 | 261 |

The results in Table 2 show that the ferric complex salt of the ligands of this invention rapidly remove silver from each type of film.

EXAMPLE 16

Rehalogenating Bleaching Rates of Silver Removal

Sample strips of four commercial color negative films were flash exposed (0.01 sec, 3000K light) then developed and fixed, but not bleached, using a conventional color negative process. The film strips were air-dried.

To measure bleaching rate, a 1.3 $cm^2$ round piece was cut from each film sample and placed as a window in a flow cell. This cell, 1 cm×1 cm×2 cm, was constructed to hold the round film sample in the light path of a diode array spectrophotometer, enabling light absorption of the film to be measured while processing solution was circulated over the sample piece. Both the processing solution, 60 mL, and the flow cell were held at a constant temperature of 25 degrees C. Three hundred absorbance measurements at 810 nm were collected at either 2-second or 4-second intervals over a 600- or 1200-second time period, respectively. The absorbance was plotted as a function of time, and the time required for 50% bleaching was determined graphically from the absorbance change. Control experiments indicated that this flow method is an excellent predictor of bleaching rates in a standard process run at 37.7 degrees C.

The resulting bleaching rates at pH 5, using the following processing solution composition, are presented in Table 3 for the four films.

| | |
|---|---|
| Ferric nitrate | 0.1 mol/L |
| Potassium Bromide | 0.47 mol/L |
| Glacial acetic acid | 30 ml/L |
| Iron complexing agent | See table 3 |
| pH adjusted to 5 with ammonium hydroxide | |

TABLE 3

| Ligand | Mol Ratio to Fe | Time for 50% Bleaching (s) Film 1 | Film 2 | Film 3 | Film 4 |
|---|---|---|---|---|---|
| EDDS (comp.) | 1.1 | 204 | 196 | 278 | 208 |
| EDMS | 1.1 | 94 | 92 | 164 | 109 |

Film 1 = Kodak GOLD 100 Plus ™ ; Film 2 = Kodak FUNTIME 200 ™
Film 3 = Kodak ROYAL GOLD 1000 ™ ; Film 4 = Kodak ULTRA 100 ™

It is clear from the results in Table 3 that EDMS bleaches silver rapidly in a rehalogenating processing solution.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. An aqueous photographic processing solution that is either a bleaching or bleach-fixing solution, said processing solution comprising a metal complex of a polyamino monosuccinic acid or salt thereof, said polyamino monosuccinic acid being:

ethylenediamine-N-monosuccinic acid, ethylenediamine-N-methyl-N'-monosuccinic acid, ethylenediamine-N-methyl-N-monosuccinic acid, ethylenediamine-N-carboxymethyl-N'-monosuccinic acid, ethylenediamine-N-carboxymethyl-N-monosuccinic acid, 1,2-propylenediamine-2-N-monosuccinic acid, 1,2-propylenediamine-1-N-monosuccinic acid, 1,3-propylenediamine-N-monosuccinic acid, ethylenediamine-N-hydroxyethyl-N'-monosuccinic acid, or 2-hydroxypropylene-1,3-diamine-N-monosuccinic acid, wherein if said processing solution is a bleaching solution, it further comprises a water-soluble rehalogenating agent, and if said processing solution is a bleach-fixing solution, it further comprises a silver halide solvent.

2. The processing solution of claim 1 wherein said polyamino monosuccinic acid is ethylenediamine-N-monosuccinic acid.

3. The processing solution of claim 1 wherein said metal complex is present in an amount of from about 0.05 to about 1 mol/l.

4. The processing solution of claim 1 that is a bleaching solution.

5. The processing solution of claim 4 wherein said rehalogenating agent is bromide ion.

6. The processing solution of claim 1 having a pH of from about 2 to about 10.

7. The processing solution of claim 1 that is a bleach-fixing solution.

8. The processing solution of claim 7 wherein said silver halide solvent is an ammonium or alkali metal thiosulfate.

9. The processing solution of claim 1 wherein said metal complex is an iron, manganese, cobalt or copper complex of said polyamino monosuccinic acid or salt thereof.

10. The processing solution of claim 9 wherein said metal complex is an iron complex of said polyamino monosuccinic acid or salt thereof.

11. The processing solution of claim 1 further comprising at least one metal complex of an aminopolycarboxylic acid which is nitrilotriacetic acid, ethylenediaminetetraacetic acid, β-alaninediacetic acid, methyliminodiacetic acid or ethylenediamine-N,N'-disuccinic acid.

12. The processing solution of claim 11 wherein said metal complex of said polyamino monosuccinic acid comprises at least about 10 mol % of the total metal complexes in said solution.

13. An aqueous photographic processing solution that is either a bleaching or bleach-fixing solution, said processing solution comprising a metal complex of a polyamino monosuccinic acid or salt thereof, said polyamino monosuccinic acid being selected from the group consisting of:

ethylenediamine-N-monosuccinic acid, diethylenetriamine-N-monosuccinic acid, triethylenetetramine-N-monosuccinic acid, 1,6-hexamethylenediamine-N-monosuccinic acid, 2-hydroxypropylene-1,3-diamine-N-monosuccinic acid, 1,2-propylenediamine-2-N-monosuccinic acid, 1,2-propylenediamine-1-N-monosuccinic acid, 1,3-propylenediamine-N-monosuccinic acid, cis-cyclohexanediamine-N-monosuccinic acid, trans-cyclohexanediamine-N-monosuccinic acid, ethylene-bis(oxyethylenenitrilo)-N-monosuccinic acid, ethylenediamine-N-carboxymethyl-N'-monosuccinic acid, ethylenediamine-N-carboxylmethyl-N-monosuccinic acid, ethylenediamine-N-carboxyethyl-N'-monosuccinic acid, ethylenediamine-N-methyl-N'-monosuccinic acid, ethylenediamine-N-methyl-N-monosuccinic acid, ethylenediamine-N-phosphonomethyl-N'-monosuccinic acid, ethylenediamine-N-sulfonomethyl-N'-monosuccinic acid, ethylenediamine-N-hydroxyethyl-N'-monosuccinic acid, ethylenediamine-N-hydroxypropyl-N'-monosuccinic acid, ethylenediamine-N-hydroxybutyl-N'-monosuccinic acid, ethylenediamine-N-sulfonomethyl-N'-monosuccinic acid, ethylenediamine-N-2-hydroxy-3-sulfopropyl-N'-monosuccinic acid, ethylenediamine-N-methylene hydroxamate-N'-monosuccinic acid, diethylenetriamine-N-carboxymethyl-N"-monosuccinic acid, diethylenetriamine-N-hydroxyethyl-N"-monosuccinic acid, diethylenetriamine-N-hydroxypropyl-N"-monosuccinic acid, diethylenetriamine-N-carboxyethyl-N"-monosuccinic acid, diethylenetriamine-N-methyl-N"-monosuccinic acid, diethylenetriamine-N-phosphonomethyl-N"-monosuccinic acid, diethylenetriamine-N-sulfonomethyl-N"-monosuccinic acid, 1,6-hexamethylenediamine-N-carboxymethyl-N'-monosuccinic acid, 1,6-hexamethylenediamine-N-carboxyethyl-N'-monosuccinic acid, 1,6-hexamethylenediamine-N-hydroxyethyl-N'-monosuccinic acid, 1,6-hexamethylenediamine-N-hydroxypropyl-N'-monosuccinic acid, 1,6-hexamethylenediamine-N-methyl-N'-monosuccinic acid, 1,6-hexamethylenediamine-N-phosphonomethyl-N'-monosuccinic acid, 1,6-hexamethylenediamine-N-sulfonomethyl-N'-monosuccinic acid, 2-hydroxypropylene-1,3-diamino-N-carboxymethyl-N'-monosuccinic acid, 2-hydroxypropylene-1,3-diamino-N-carboxyethyl-N'-monosuccinic acid, 2-hydroxypropylene-1,3-diamino-N-hydroxyethyl-N'-monosuccinic acid, 2-hydroxypropylene-1,3-diamino-N-hydroxypropyl-N'-monosuccinic acid, 2-hydroxypropylene-1,3-diamino-N-methyl-N'-monosuccinic acid, 2-hydroxypropylene-1,3-diamino-N-phosphonomethyl-N'-monosuccinic acid, 2-hydroxypropylene-1,3-diamino-N-sulfonomethyl-N'-monosuccinic acid, 1,2-propylenediamine-N-carboxymethyl-N'-monosuccinic acid, 1,2-propylenediamine-N-carboxyethyl-N'-monosuccinic acid, 1,2-propylenediamine-N-methyl-N'-monosuccinic acid, 1,2-propylenediamine-N-hydroxyethyl-N'-monosuccinic acid, 1,2-propylenediamine-N-hydroxypropyl-N'-monosuccinic acid, 1,2-propylenediamine-N-phosphonomethyl-N'-monosuccinic acid, 1,2-propylenediamine-N-sulfonomethyl-N'-monosuccinic acid, 1,3-propylenediamine-N-carboxymethyl-N'-monosuccinic acid, 1,3-propylenediamine-N-carboxyethyl-N'-monosuccinic acid, 1,3-propylenediamine-N-methyl-N'-monosuccinic acid, 1,3-propylenediamine-N-hydroxyethyl-N'-monosuccinic acid, 1,3-propylenediamine-N-hydroxypropyl-N'-monosuccinic acid, 1,3-propylenediamine-N-phosphonomethyl-N'-monosuccinic acid, 1,3-propylenediamine-N-sulfonomethyl-N'-monosuccinic acid, cis & trans-cyclohexanediamine-N-carboxymethyl-N'-monosuccinic acid, cis & trans-cyclohexanediamine-N-carboxyethyl-N'-monosuccinic acid, cis & trans-cyclohexanediamine-N-methyl-N'-monosuccinic acid, cis & trans-cyclohexanediamine-N-hydroxyethyl-N'-monosuccinic acid, cis & trans-cyclohexanediamine-N-hydroxypropyl-N'-monosuccinic acid, cis & trans-cyclohexanediamine-N-phosphonomethyl-N'-monosuccinic acid, cis & trans-cyclohexanediamine-N-sulfonomethyl-N'-monosuccinic acid, ethylene-bis(oxyethylenenitrilo)-N-carboxymethyl-N'-monosuccinic acid, ethylene-bis(oxyethylenenitrilo)-N-carboxyethyl-N'-monosuccinic acid, ethylene-bis(oxyethylenenitrilo)-N-methyl-N'-monosuccinic acid, ethylene-bis(oxyethylenenitrilo)-N-hydroxyethyl-N'-monosuccinic acid, ethylene-bis(oxyethylenenitrilo)-N-hydroxypropyl-N'-monosuccinic acid, ethylene-bis(oxyethylenenitrilo)-N-phosphonomethyl-N'-monosuccinic acid, ethylene-bis(oxyethylenenitrilo)-N-sulfonomethyl-N'-monosuccinic acid, triethylenetetramine-N-carboxymethyl-N'''-monosuccinic acid, triethylenetetramine-N-carboxyethyl-N'''-monosuccinic acid, triethylenetetramine-N-methyl-N'''-monosuccinic acid, triethylenetetramine-N-hydroxyethyl-N'''-monosuccinic acid, triethylenetetramine-N-hydroxypropyl-N'''-monosuccinic acid, triethylenetetramine-N-phosphonomethyl-N'''-monosuccinic acid, and triethylenetetramine-N-sulfonomethyl-N'''-monosuccinic acid, wherein if said processing solution is a bleaching solution, it further comprises a water-soluble rehalogenating agent, and if said processing solution is a bleach-fixing solution, it further comprises a silver halide solvent.

14. The processing solution of claim 13 further comprising at least one metal complex of an aminopolycarboxylic acid which is nitrilotriacetic acid, ethylenediaminetetraacetic acid, β-alaninediacetic acid, methyliminodiacetic acid or ethylenediamine-N,N'-disuccinic acid.

15. The processing solution of claim 14 wherein said metal complex of said polyamino monosuccinic acid comprises at least about 10 mol % of the total metal complexes in said solution.

16. A method of bleaching or bleach-fixing an imagewise exposed and developed color silver halide photographic material comprising contacting said photographic material with a bleaching or bleach-fixing solution comprising a metal complex of a polyamino monosuccinic acid or salt thereof, said polyamino monosuccinic acid being:

ethylenediamine-N-monosuccinic acid, ethylenediamine-N-methyl-N'-monosuccinic acid, ethylenediamine-N-methyl-N-monosuccinic acid, ethylenediamine-N-carboxymethyl-N'-monosuccinic acid, ethylenediamine-N-carboxymethyl-N-monosuccinic acid, 1,2-propylenediamine-2-N-monosuccinic acid, 1,2-propylenediamine-1-N-monosuccinic acid, 1,3-propylenediamine-N-monosuccinic acid, ethylenediamine-N-hydroxyethyl-N'-monosuccinic acid, or 2-hydroxypropylene-1,3-diamine-N-monosuccinic acid.

17. The method of claim 16 wherein said bleaching solution further comprises a water-soluble rehalogenating agent.

18. The method of claim 16 comprising bleach-fixing said material with a bleach-fixing solution comprising said metal complex and a silver halide solvent.

19. The method of claim 16 wherein said photographic material has a total silver coverage of less than or equal to about 1 $g/m^2$.

20. The method of claim 16 wherein said photographic material has a silver halide emulsion whose silver halide content comprises at least about 90 mol % silver chloride.

21. A method of bleaching or bleach-fixing an imagewise exposed and developed color silver halide photographic material comprising contacting said photographic material with a bleaching or bleach-fixing solution comprising a metal complex of a polyamino monosuccinic acid or salt thereof, said polyamino monosuccinic acid being selected from the group consisting of:

ethylenediamine-N-monosuccinic acid, diethylenetriamine-N-monosuccinic acid, triethylenetetramine-N-monosuccinic acid, 1,6-hexamethylenediamine-N-monosuccinic acid, 2-hydroxypropylene-1,3-diamine-N-monosuccinic acid, 1,2-propylenediamine-2-N-monosuccinic acid, 1,2-propylenediamine-1-N-monosuccinic acid, 1,3-propylenediamine-N-monosuccinic acid, cis-cyclohexanediamine-N-monosuccinic acid, trans-cyclohexanediamine-N-monosuccinic acid, ethylene-bis(oxyethylenenitrilo)-N-monosuccinic acid, ethylenediamine-N-carboxymethyl-N'-monosuccinic acid, ethylenediamine-N-carboxylmethyl-N-monosuccinic acid, ethylenediamine-N-carboxyethyl-N'-monosuccinic acid, ethylenediamine-N-methyl-N'-monosuccinic acid, ethylenediamine-N-methyl-N-monosuccinic acid, ethylenediamine-N-phosphonomethyl-N'-monosuccinic acid, ethylenediamine-N-sulfonomethyl-N'-monosuccinic acid, ethylenediamine-N-hydroxyethyl-N'-monosuccinic acid, ethylenediamine-N-hydroxypropyl-N'-monosuccinic acid, ethylenediamine-N-hydroxybutyl-N'-monosuccinic acid, ethylenediamine-N-sulfonomethyl-N'-monosuccinic acid, ethylenediamine-N-2-hydroxy-3-sulfopropyl-N'-monosuccinic acid, ethylenediamine-N-methylene hydroxamate-N'-monosuccinic acid, diethylenetriamine-N-carboxymethyl-N''-monosuccinic acid, diethylenetriamine-N-hydroxyethyl-N''-monosuccinic acid, diethylenetriamine-N-hydroxypropyl-N''-monosuccinic acid, diethylenetriamine-N-carboxyethyl-N''-monosuccinic acid, diethylenetriamine-N-methyl-N''-monosuccinic acid, diethylenetriamine-N-phosphonomethyl-N''-monosuccinic acid, diethylenetriamine-N-sulfonomethyl-N''-monosuccinic acid, 1,6-hexamethylenediamine-N-carboxymethyl-N'-monosuccinic acid, 1,6-hexamethylenediamine-N-carboxyethyl-N'-monosuccinic acid, 1,6-hexamethylenediamine-N-hydroxyethyl-N'-monosuccinic acid, 1,6-hexamethylenediamine-N-hydroxypropyl-N'-monosuccinic acid, 1,6-hexamethylenediamine-N-methyl-N'-monosuccinic acid, 1,6-hexamethylenediamine-N-phosphonomethyl-N'-monosuccinic acid, 1,6-hexamethylenediamine-N-sulfonomethyl-N'-monosuccinic acid, 2-hydroxypropylene-1,3-diamino-N-carboxymethyl-N'-monosuccinic acid, 2-hydroxypropylene-1,3-diamino-N-carboxyethyl-N'-monosuccinic acid, 2-hydroxypropylene-1,3-diamino-N-hydroxyethyl-N'-monosuccinic acid, 2-hydroxypropylene-1,3-diamino-N-hydroxypropyl-N'-monosuccinic acid, 2-hydroxypropylene-1,3-diamino-N-methyl-N'-monosuccinic acid, 2-hydroxypropylene-1,3-diamino-N-phosphonomethyl-N'-monosuccinic acid, 2-hydroxypropylene-1,3-diamino-N-sulfonomethyl-N'-monosuccinic acid, 1,2-propylenediamine-N-carboxymethyl-N'-monosuccinic acid, 1,2-propylenediamine-N-carboxyethyl-N'-monosuccinic acid, 1,2-propylenediamine-N-methyl-N'-monosuccinic acid, 1,2-propylenediamine-N-hydroxyethyl-N'-monosuccinic acid, 1,2-propylenediamine-N-hydroxypropyl-N'-monosuccinic acid, 1,2-propylenediamine-N-phosphonomethyl-N'-monosuccinic acid, 1,2-propylenediamine-N-sulfonomethyl-N'-monosuccinic acid, 1,3-propylenediamine-N-carboxymethyl-N'-monosuccinic acid, 1,3-propylenediamine-N-carboxyethyl-N'-monosuccinic acid, 1,3-propylenediamine-N-methyl-N'-monosuccinic acid, 1,3-propylenediamine-N-hydroxyethyl-N'-monosuccinic acid, 1,3-propylenediamine-N-hydroxypropyl-N'-monosuccinic acid, 1,3-propylenediamine-N-phosphonomethyl-N'-monosuccinic acid, 1,3-propylenediamine-N-sulfonomethyl-N'-monosuccinic acid, cis & trans-cyclohexanediamine-N-carboxymethyl-N'-monosuccinic acid, cis & trans-cyclohexanediamine-N-carboxyethyl-N'-monosuccinic acid, cis & trans-cyclohexanediamine-N-methyl-N'-monosuccinic acid, cis & trans-cyclohexanediamine-N-hydroxyethyl-N'-monosuccinic acid, cis & trans-cyclohexanediamine-N-hydroxypropyl-N'-monosuccinic acid, cis & trans-cyclohexanediamine-N-phosphonomethyl-N'-monosuccinic acid, cis & trans-cyclohexanediamine-N-sulfonomethyl-N'-monosuccinic acid, ethylene-bis(oxyethylenenitrilo)-N-carboxymethyl-N'-monosuccinic acid, ethylene-bis(oxyethylenenitrilo)-N-carboxyethyl-N'-monosuccinic acid, ethylene-bis(oxyethylenenitrilo)-N-methyl-N'-monosuccinic acid, ethylene-bis(oxyethylenenitrilo)-N-hydroxyethyl-N'-monosuccinic acid, ethylene-bis(oxyethylenenitrilo)-N-hydroxypropyl-N'-monosuccinic acid, ethylene-bis(oxyethylenenitrilo)-N-phosphonomethyl-N'-monosuccinic acid, ethylene-bis(oxyethylenenitrilo)-N-sulfonomethyl-N'-monosuccinic acid, triethylenetetramine-N-carboxymethyl-N'''-monosuccinic acid, triethylenetetramine-N-carboxyethyl-N'''-monosuccinic acid, triethylenetetramine-N-methyl-N'''-monosuccinic acid, triethylenetetramine-N-hydroxyethyl-N'''-monosuccinic acid, triethylenetetramine-N-hydroxypropyl-N'''-monosuccinic acid, triethylenetetramine-N-phosphonomethyl-N'''-monosuccinic acid, and triethylenetetramine-N-sulfonomethyl-N'''-monosuccinic acid.

22. The method of claim 21 wherein said bleaching solution further comprises a water-soluble rehalogenating agent.

23. The method of claim 21 comprising bleach-fixing said material with a bleach-fixing solution comprising said metal complex and a silver halide solvent.

24. The method of claim 21 wherein said photographic material has a total silver coverage of less than or equal to about 1 $g/m^2$.

25. The method of claim 21 wherein said photographic material has a silver halide emulsion whose silver halide content comprises at least about 90 mol % silver chloride.

26. The method of claim 21 wherein said photographic material has been color developed using a color developing solution comprising a color developing agent and a substituted or unsubstituted monoalkyl- or dialkylhydroxylamine.

27. The method of claim 21 wherein said photographic material comprises a magnetic recording layer.

28. A method of bleaching or bleach-fixing an imagewise exposed and developed silver halide photographic material comprising contacting said photographic material with the processing solution of claim 11.

29. An aqueous photographic bleaching solution comprising a metal complex of a polyamino monosuccinic acid or salt thereof, said polyamino monosuccinic acid being:

ethylenediamine-N-monosuccinic acid, ethylenediamine-N-methyl-N'-monosuccinic acid, ethylenediamine-N-methyl-N-monosuccinic acid, ethylenediamine-N-carboxymethyl-N'-monosuccinic acid, ethylenediamine-N-carboxymethyl-N-monosuccinic acid, 1,2-propylenediamine-2-N-monosuccinic acid, or 1,2-propylenediamine-1-N-monosuccinic acid.

30. An aqueous photographic bleach-fixing solution comprising a metal complex of a polyamino monosuccinic acid or salt thereof, said polyamino monosuccinic acid being:

ethylenediamine-N-monosuccinic acid, ethylenediamine-N-methyl-N'-monosuccinic acid, ethylenediamine-N-methyl-N-monosuccinic acid, ethylenediamine-N-carboxymethyl-N'-monosuccinic acid, ethylenediamine-N-carboxymethyl-N-monosuccinic acid, 1,2-propylenediamine-2-N-monosuccinic acid, or 1,2-propylenediamine-1-N-monosuccinic acid.

* * * * *